US010527054B2

(12) United States Patent
Orangi

(10) Patent No.: US 10,527,054 B2
(45) Date of Patent: Jan. 7, 2020

(54) IMPELLER FOR CENTRIFUGAL FANS

(71) Applicant: Mohammad Hassan Orangi, Tehran (IR)

(72) Inventor: Mohammad Hassan Orangi, Tehran (IR)

( * ) Notice: Subject to any disclaimer, the term of this patent is extended or adjusted under 35 U.S.C. 154(b) by 96 days.

(21) Appl. No.: 15/604,446

(22) Filed: May 24, 2017

(65) Prior Publication Data

US 2017/0254339 A1 Sep. 7, 2017

Related U.S. Application Data

(60) Provisional application No. 62/340,531, filed on May 24, 2016.

(51) Int. Cl.
*F04D 29/28* (2006.01)
*F04D 29/30* (2006.01)

(52) U.S. Cl.
CPC ..... *F04D 29/282* (2013.01); *F04D 29/30* (2013.01); *Y10S 416/02* (2013.01)

(58) Field of Classification Search
CPC ..... F04D 29/282; F04D 29/283; F04D 29/30; F04D 29/28; Y10S 416/02
See application file for complete search history.

(56) References Cited

U.S. PATENT DOCUMENTS 3,306,528 A * 2/1967 Eck ..... F04D 29/282 415/116
3,394,876 A * 7/1968 Eck ..... F04D 29/30 416/178
4,165,950 A * 8/1979 Masai ..... F04D 29/282 416/178
5,586,053 A * 12/1996 Park ..... F04D 29/30 416/178
6,007,300 A * 12/1999 Saeki ..... F04D 29/283 416/178
6,261,051 B1 * 7/2001 Kolacny ..... F01D 1/14 415/224
6,685,430 B2 * 2/2004 Chapman ..... F04D 17/165 415/208.2
7,210,907 B2 * 5/2007 Patti ..... F04D 29/282 416/178
8,011,891 B2 * 9/2011 Ochiai ..... F04D 29/282 416/188
10,030,667 B2 * 7/2018 Pirouzpanah ..... F04D 29/283
2002/0023728 A1 * 2/2002 Kikuchi ..... B22D 17/04 164/113
2007/0166177 A1 * 7/2007 Lopatinsky ..... F04D 17/04 417/423.1
2018/0238351 A1 * 8/2018 Kong ..... F04D 29/30

* cited by examiner

*Primary Examiner* — Nathan C Zollinger
(74) *Attorney, Agent, or Firm* — NovoTechIP International PLLC

(57) ABSTRACT

A multi-blade forward-curved impeller for a centrifugal fan is disclosed. The impeller may include a blade having a curved portion and an extended portion. The curved portion may have a leading edge and a trailing edge, and the extended portion may extend outward from the trailing edge of the curved portion.

16 Claims, 8 Drawing Sheets

IMPELLER FOR CENTRIFUGAL FANS

CROSS REFERENCE TO RELATED APPLICATION

This application claims the benefit of priority from U.S. Provisional Patent Application Ser. No. 62/340,531, filed on May 24, 2016 and entitled "Circular Arc-extended Tip Blades Impeller in Forward Curved (FC) fans," which is incorporated herein by reference in its entirety.

TECHNICAL FIELD

The present disclosure generally relates to centrifugal fans, particularly to impellers of the centrifugal fans, and more particularly to impellers of forward-curved centrifugal fans.

BACKGROUND

A centrifugal fan is a mechanical device for moving air or other gases. Centrifugal fans increase the speed of an air stream with their rotating impellers. A centrifugal fan may be a drum-shaped device having a number of fan blades that are mounted around a fan wheel. The fan wheel may turn on a driveshaft which is mounted on bearings in a fan housing. A gas or air may enter from the side of the fan wheel, and the wheel may turn about 90 degrees and accelerate due to centrifugal and Coriolis forces as the gas or air flows over the fan blades and exits the fan housing.

Disclosed methods and devices herein are directed to an apparatus for use with fan systems. Typically, fan blades on the hub may be arranged in three different ways: forward-curved, backward-curved or radial Tip. Forward-curved (herein after "FC") blades curve in the direction of the fan wheel's rotation. FC blades provide a low noise level and relatively high air flow with a high increase in static pressure. In these types of fans, flow acceleration in the blade channels may be one of the determining factors in fan performance.

Generally, the performance of FC fans may be a function of parameters that include the angle of attack at the leading edge of a blade and/or the magnitude of the separation that occurs at the suction side of a blade which may further cause a pressure loss in the fan, as well as other factors. In some cases, decreasing the angle of the blade's leading edge may decrease the entry shock loss and separation loss on the suction side of the blade. However, due to flow deceleration in the blade channel, the performance of the FC centrifugal fan may decrease. Therefore, there is a need in the art for centrifugal fan impellers in which shock loss and separation loss is decreased while maintaining the performance and efficiency of the impeller.

SUMMARY

This summary is intended to provide an overview of the subject matter of this patent, and is not intended to identify essential elements or key elements of the subject matter, nor is it intended to be used to determine the scope of the claimed implementations. The proper scope of this patent may be ascertained from the claims set forth below in view of the detailed description below and the drawings.

In one general aspect, the present disclosure is directed to a forward-curved impeller for a centrifugal fan. The impeller may include a first blade, where the first blade has a first curved portion and a first extended portion. In addition, the curved portion includes a leading edge and a trailing edge, and the first extended portion extends outward from the trailing edge of the first curved portion.

The above general aspect may include one or more of the following features. For example, the first blade may further include an inlet blade angle that is between 5° and 70° or the first blade can include an outlet blade angle that is between 120° and 180°. In some cases, the first extended portion comprises a substantially flat outer surface or a curved outer surface. The first curved portion may also include a profile that is selected from the group consisting of a substantially circular profile, a substantially elliptical profile, and a substantially parabolic profile. In another instance, the impeller further includes a plurality of blades, where each of the blades of the plurality of blades may include a curved portion, where each curved portion includes a leading edge and a trailing edge. In some cases, the forward-curved impeller includes an inner diameter and an outer diameter, the inner diameter being associated with a circle extending along or being bounded by the leading edges of the curved portions of each blade, the outer diameter being associated with a circle extending along or being bounded by the trailing edges of the curved portions of each blade, where a ratio of the inner diameter to the outer diameter is at most 1. Furthermore, in one case the inlet blade angle can be variable along a length of the first blade, and/or the outlet blade angle can be variable along a length of the first blade. In addition, the extended portion may be either non-tangential to the trailing edge of the curved portion or be tangential to the trailing edge of the curved portion. In another instance, the curved portion is a substantially circular curved portion, wherein a radius of the circular curved portion follows:

$$R = \frac{d2 \times \left(1 - \frac{d1}{d2}\right)}{2\mathrm{Cos}(\Phi) \times \mathrm{Sin}(\alpha)} \times \mathrm{Sin}(\Gamma)$$

where $\alpha=\beta'_2-\beta'_1$, $\Phi=(\beta'_1-(180-\beta'_2))/2$, and $\Gamma=(\beta'_1+(180-\beta'_2))/2$ and where $d_1$ is an inner diameter of the impeller, $d_2$ is an outer diameter of the impeller, $\beta'_1$ is an inlet angle of the blade, and $\beta'_2$ is an outlet angle of the blade. In one example, the first blade includes an inlet blade angle that is at least 5° and an outlet blade angle that is at least 120°. In another example, the first blade includes an inlet blade angle that is at most 70° and an outlet blade angle that is at most 180°. In some cases, the plurality of blades further include a second blade with a second extended portion, where a channel extends between the first blade and the second blade, and where the first extended portion and the second extended portion are configured to allow gas to flow through the channel with negligible separation loss. In another example, the outlet blade angle is approximately 169° and the inlet blade angle is approximately 26°. In addition, the inner diameter of the forward-curved impeller may be approximately 430 mm and the outer diameter of the forward-curved impeller may be approximately 475 mm. In one instance, the first extended portion has a length of about 15 mm and is tangential to the first curved portion at the trailing edge. In another instance, the first extended portion has a thickness of approximately 1 mm.

Other systems, methods, features and advantages of the implementations will be, or will become, apparent to one of ordinary skill in the art upon examination of the following figures and detailed description. It is intended that all such additional systems, methods, features and advantages be included within this description and this summary, be within the scope of the implementations, and be protected by the following claims.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

In the following detailed description, numerous specific details are set forth by way of examples in order to provide a thorough understanding of the relevant teachings. However, it should be apparent that the present teachings may be practiced without such details. In other instances, well known methods, procedures, components, and/or circuitry have been described at a relatively high-level, without detail, in order to avoid unnecessarily obscuring aspects of the present teachings.

As noted above, in FC centrifugal fans, blades are curved forward, i.e., in the direction of the rotation. For purposes of references, it should be understood that each curved blade includes a "leading edge" and a "trailing edge". An impeller can suck air from an axial direction parallel to the rotational direction of the drive shaft and blow the air toward a radial direction parallel to the radial direction of the fan wheel. Air or gas reaches the blades with an angle of attack at or along the leading edge and departs the blades at or along the trailing edge. In case of a large angle of attack at or on the leading edge, a large separation may occur in the suction side of a blade, which may lead to a decrease in the efficiency of FC centrifugal fans.

The present disclosure is directed to an impeller for FC centrifugal fans that includes a blade with a small inlet angle at the leading edge of the blade and a large outlet angle at the trailing edge of the blade. The blade also includes an extended portion, such as a narrow plate-like portion, that can increase the overall width of the blade. This type of blade design can minimize shock loss and separation loss while maintaining the performance and efficiency of the impeller.

In the impeller of the present disclosure, in order to increase the efficiency of the fan, the inlet angle of the blade at the leading edge is reduced. In some cases, this may result in deceleration of the flow and consequently a reduction in performance and efficiency. In different implementations, an extended tip portion may be provided at or along the trailing edge of the blade to compensate for this loss and/or improve performance and efficiency. In some implementations, the extended tip portion may be a curved or non-curved portion that is provided at or along the trailing edge of the blade, thereby defining a new trailing edge region.

Figure 1A:
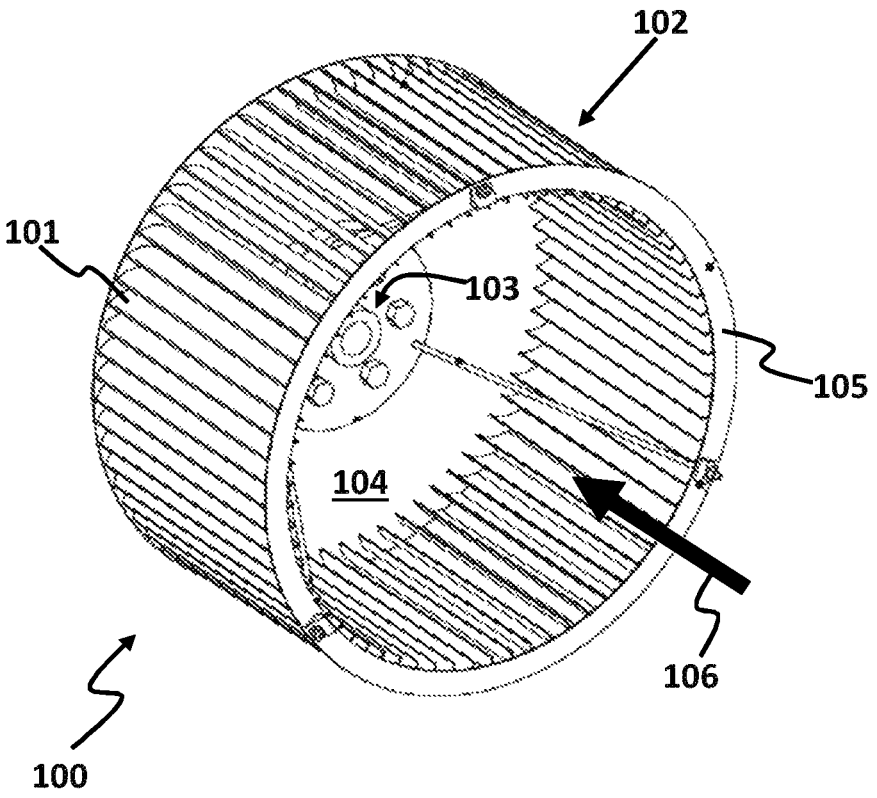
FIG. 1A is a perspective view of an implementation of a multi-blade forward-curved centrifugal impeller with an overhung configuration.
Figure 1B:
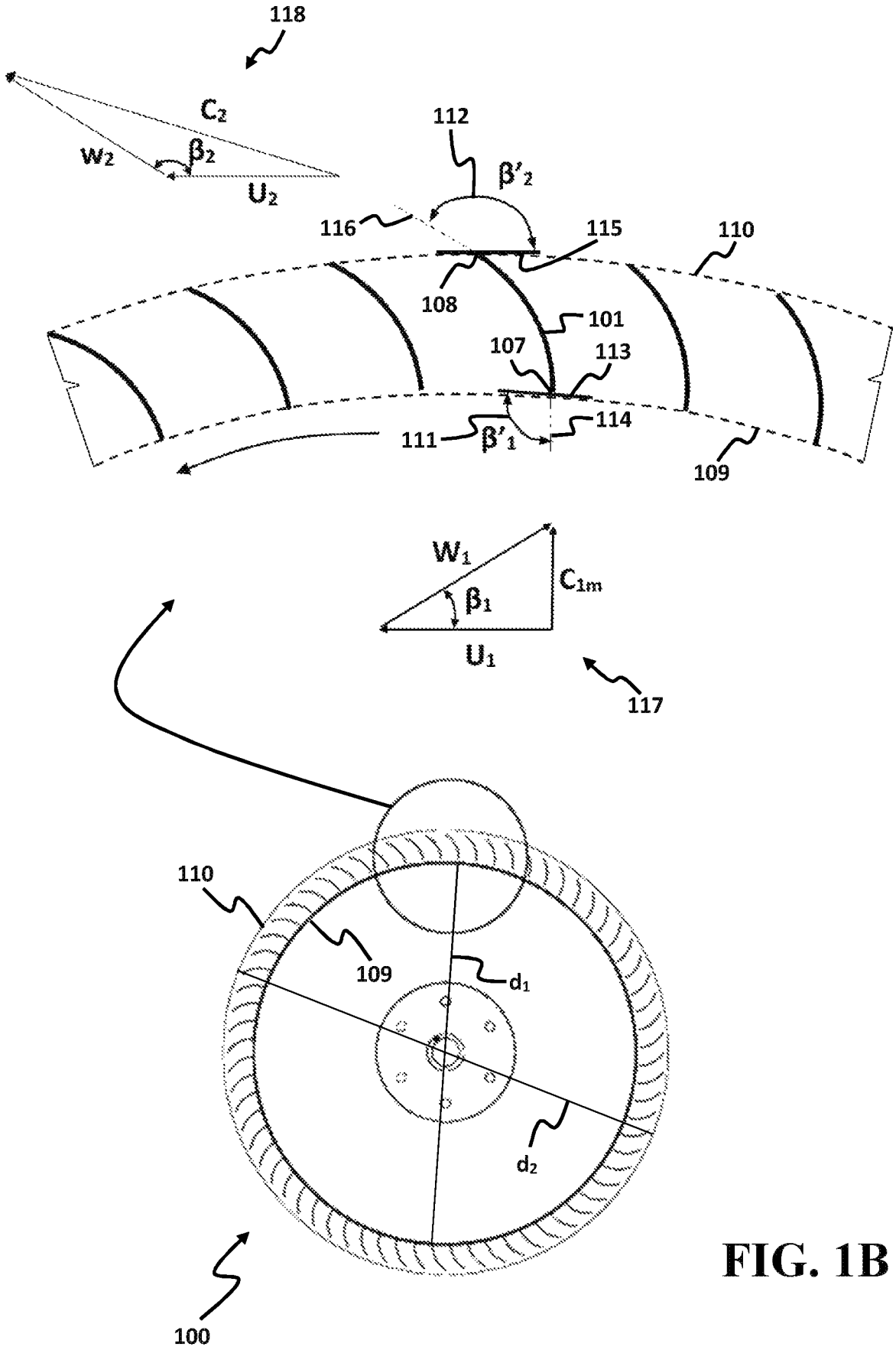
FIG. 1B is a sectional view of an implementation of a multi-blade forward-curved centrifugal impeller along the plane perpendicular to the rotational axis of the impeller.
Figure 1C:
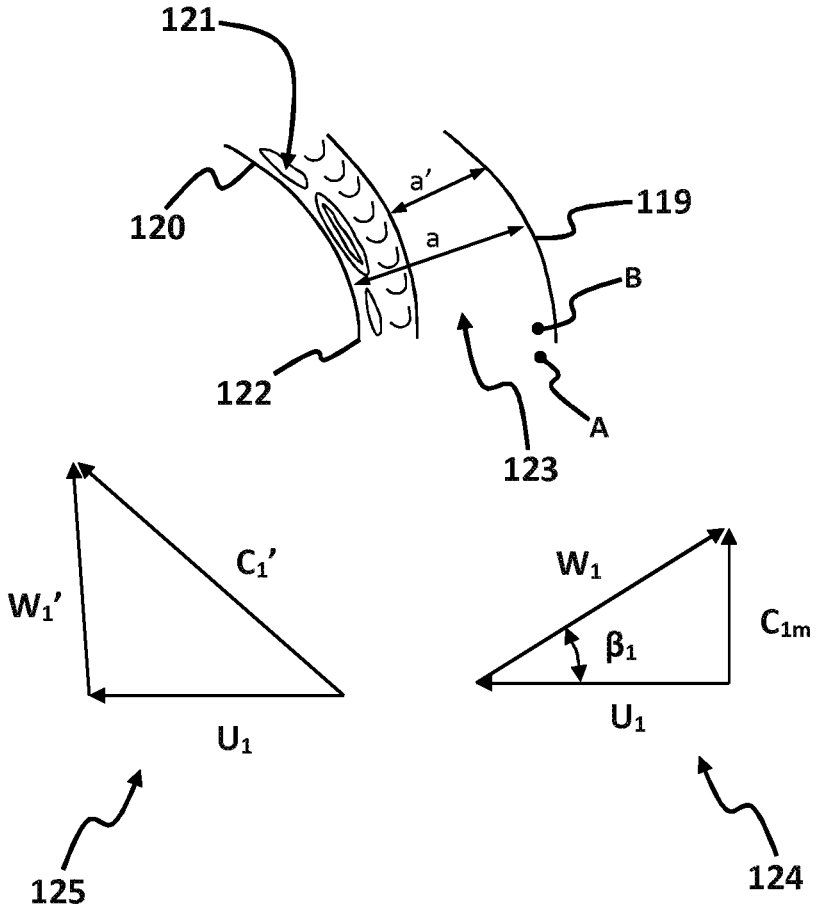
FIG. 1C illustrates an implementation of two consecutive blades of a multi-blade forward-curved centrifugal impeller.

For purposes of reference, FIGS. 1A-1C provide the reader with an overview of various components and features of an FC centrifugal fan. FIG. 1A illustrates an impeller 100 that can be used in an FC centrifugal fan. Impeller 100 may include a number of blades 101. The blades 101 can be arranged in a wheel configuration 102. As shown in FIG. 1A, in one implementation, impeller 100 may have an overhung wheel configuration 102 that may be mounted on a shaft-and-bearing assembly 103. In addition, the blades 101 may be mounted between a back plate 104 and a shroud 105. Impeller 100 of FIG. 1A depicts a single-suction impeller, in which an inlet gas flow may enter impeller 100 in an axial direction, as represented by arrow 106, and then can be redirected along a radial direction in order to exit the impeller 100. The back plate 104 may be configured to provide an airflow surface on the base of impeller 100, thereby assisting in redirecting the incoming air flow into the single suction impeller 100. According to other implementations (not shown in FIG. 1A), impeller 100 may be a double-suction impeller and have a wheel configuration that may be supported by various supporting components, such as for example, between two bearings. In such a wheel configuration that is supported between bearings, blades 101 may be mounted between two shrouds.

The overhung configuration or arrangement of blades may be incorporated in impellers that have relatively moderate width to diameter ratios, or length to diameter ratios. In some implementations, in cases of high width to diameter ratio, the impellers may be equipped with reinforcing arms to decrease the deflection and vibration of the impeller during operation. However, in lower width to diameter ratios, it may not be necessary to provide such extra reinforcement using rods or arms.

In different implementations, FC fan impellers of low or moderate speed may be made by punch forming a sheet metal to obtain a cascade of blades and joggling it to the shroud in each side by a spinning process. If the impeller is intended to work in high speed, each blade may be formed by a bending operation separately. The bended blades may then be mounted between the back plate and the shroud in a single suction impeller or between the two shrouds in a double suction impeller.

FIG. 1B depicts a cross-sectional view of impeller 100 along a plane perpendicular to the longitudinal axis of the impeller 100. In some cases, as shown in FIG. 1B, gas or air can approach and/or contact a blade. For example, air can approach blade 101 along a leading edge 107 and exit from the region of the blade 101 associated with a trailing edge 108. For impeller 100, for purposes of clarity, two imaginary circles may be defined herein: an inner circle 109 with a circumference that passes through, contacts the tips of, or encircles the leading edges of all of the blades and an outer circle 110 with a circumference that passes through, contacts the tips of, or encircles the trailing edges of all the blades. The diameter of the inner circle 109 will be referred to as an inner diameter $d_1$ of impeller 100 and the diameter of the outer circle 110 will be referred to as an outer diameter $d_2$ of the impeller 100. Furthermore, for purposes of reference, two angles may be identified for each blade: an inlet blade angle ($\beta'_1$) 111 and an outlet blade angle ($\beta'_2$) 112. Inlet blade angle ($\beta'_1$) 111 is the angle between a tangent line to the inner circle at leading edge 107 (for example, a tangent line 113) and a tangent line to the curved section of blade 101 at leading edge 107 (for example, a tangent line 114). Similarly the outlet blade angle ($\beta'_2$) 112 is the angle between a tangent line to the outer circle at trailing edge 108 (for example, a tangent line 115) and a tangent line to the curved section of blade 101 at trailing edge 108 (for example, a tangent line 116). The inlet blade angle ($\beta'_1$) 111 is at least 100° in most FC centrifugal fans. In some implementations, the inlet blade angle and the outlet blade angle of an FC centrifugal fan that lacks an extended tip portion can be similar or substantially equal.

In an FC centrifugal fan, the flow dynamic is three-dimensional; therefore, flow analysis may be relatively challenging. Referring to FIG. 1B, a one-dimensional flow analysis is presented for simplicity. A first velocity triangle 117 for leading edge 107 and a second velocity triangle 118 for trailing edge 108 are shown. With reference to first velocity triangle 117, a peripheral velocity of the leading edge 107 is designated by $U_1$; a radial velocity of flow is designated by $C_{1m}$; a relative velocity between the flow and the blade leading edge 107 is designated by $W_1$. In addition, with reference to second velocity triangle 118, an absolute velocity of flow at the trailing edge 108 is designated by $C_2$; a peripheral velocity of trailing edge 108 is designated by $U_2$; and $W_2$ designates a relative velocity between the flow and the blade trailing edge 108. Furthermore, the inlet flow angle 126 is designated by $\beta_1$ in first velocity triangle 117 and the outlet flow angle 127 is designated by $\beta_2$ in second velocity triangle 118. Generally, the inlet flow angle in most FC centrifugal fans is about 10 degrees to 15 degrees, though in other cases, it may range between 5 degrees and 25 degrees.

For a blade of impeller 100, for example blade 101 in FIG. 1B, an angle of attack along the leading edge 107 may be defined as the difference between the inlet flow angle 126 and the inlet blade angle 111 (i.e., ($\beta'_1-\beta_1$)). In some cases, the angle of attack along the leading edge 107 may be between 85 and 90 degrees, though in, other cases, it may range between 80 and 95 degrees. Such a large angle of attack may result in a correspondingly large separation on the suction side of the blades in some FC fans that may further cause a relatively large pressure loss. The pressure loss due to the large angle of attack at the leading edge of the blades (i.e., shock loss) and the related separation loss on the suction side of the blades may reduce the efficiency of FC fans. Because of these losses, the efficiency of FC fans is lower than backward curved and radial-tip blade fans. The shock loss at the leading edge of each blade is defined by a large change in the flow direction in the peripheral direction, which imposes a heavy resistance torque against the rotation of the impeller.

In FC centrifugal fans an impeller diameter ratio may be defined as the ratio of the inner diameter $d_1$ of the impeller 100 to the outer diameter $d_2$ of the impeller 100. The impeller diameter ratio in FC centrifugal fans is relatively high and larger than the impeller diameter ratio in either BC or RT centrifugal fans.

FIG. 1C illustrates an example of two adjacent or consecutive blades of impeller 100, comprising a first blade 119 and a second blade 120. In different implementations, each consecutive set of blades can define a channel therein between. For example, a channel 123 extends between first blade 119 and second blade 120. Referring to FIG. 1C, separation may occur at a suction side 121 of second blade 120 due to a large angle of attack along the leading edge 122. Point A in FIG. 1C refers to the location of flow at the leading edge, just prior to the flow entering the channel. Point B in FIG. 1C refers to the location of flow at the leading edge and just after the flow enters the channel. A third velocity triangle 124 is provided for point A in which $C_1'$ is the flow absolute velocity, and a fourth velocity triangle 125 is provided for point B in which $C_{1m}$ is the flow absolute velocity. $U_1$ refers to the peripheral velocity of the leading edge 122 and $W_1$ and $W_1'$ refer to the relative velocities between the flow and the blade leading edge 122. In the example shown in FIG. 1C, due to a large angle of attack associated with the blade leading edge 122, entry flow turns immediately after entering blade channel 123, which may result in a large separation zone on blade suction side 121. Due to the separation in the blade channel 123, the depth of flow decreases from a to a'. Therefore, absolute velocity may increase from $C_{1m}$ to $C'_1$. The low pressure zone that may be created at the suction side 121 of the blade imposes a heavy torque that resists against impeller rotation, which can decrease impeller efficiency.

Figure 2A:
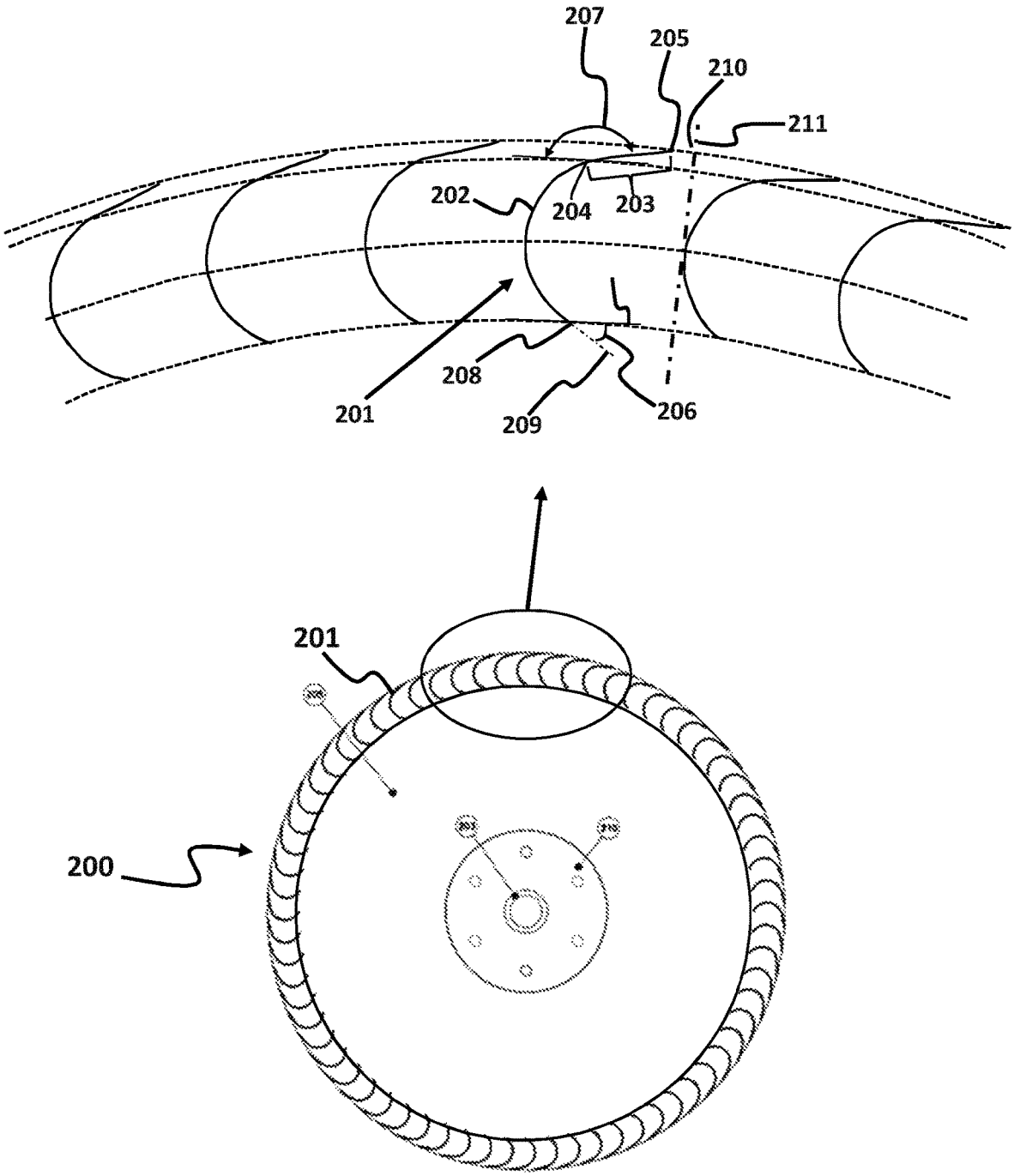
FIG. 2A is a sectional view of an implementation of a multi-blade forward-curved centrifugal impeller with extended-tip blades.
Figure 2B:
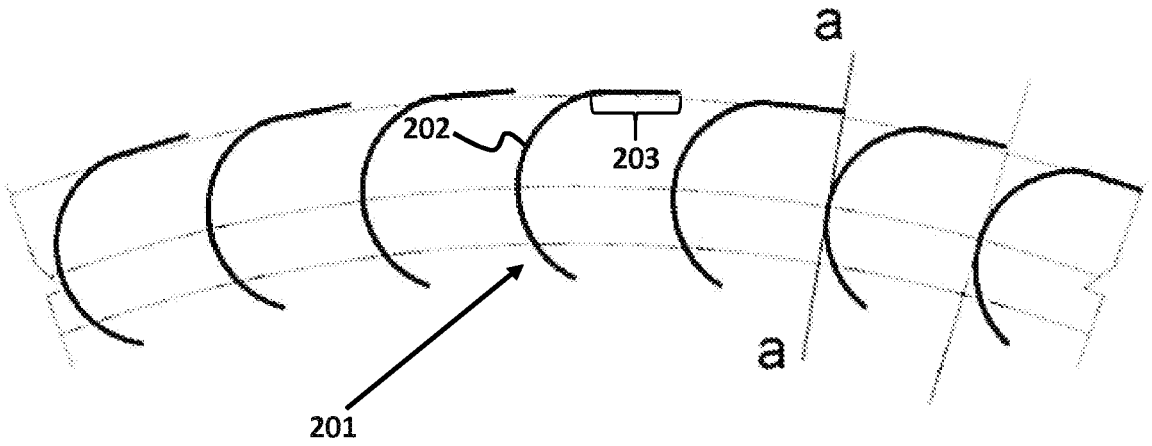
FIG. 2B illustrates the profiles of an implementation of extended-tip blades.
Figure 2C:
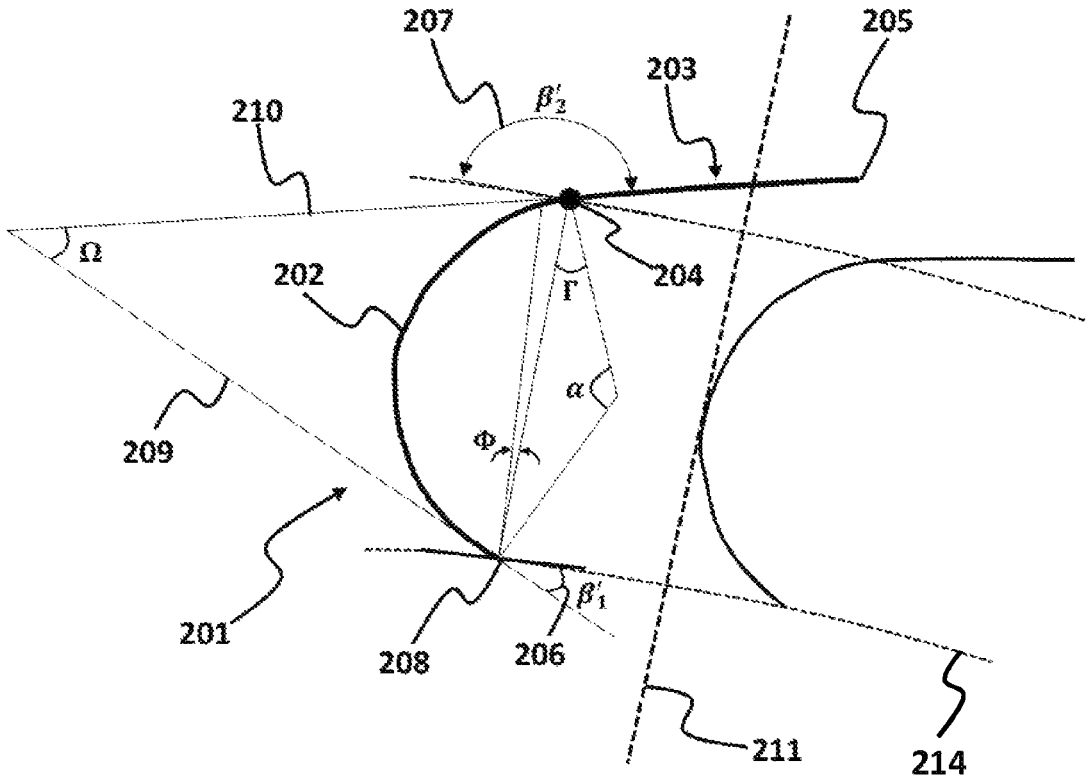
FIG. 2C illustrates an implementation of two consecutive extended-tip blades of a multi-blade forward-curved centrifugal impeller.

Referring now to FIGS. 2A-2C, some implementations of an extended-tip impeller system are depicted. FIG. 2A is a cross-sectional view of an extended-tip impeller 200 taken along the plane perpendicular to longitudinal axis of the impeller 200. The extended-tip impeller 200 may include a plurality of extended-tip blades. An extended-tip blade, such as extended-tip blade 201, may comprise two main portions: a curved portion 202 and an extended tip portion ("extended portion") 203. The extended portion 203 may be understood to comprise the portion of the blade that extends outward (i.e., in a distal direction, away from the center of the impeller) from a first trailing edge 204 of the curved portion 202 at discharge. In some implementations, the extended portion 203 further defines a second trailing edge 205 for the extended-tip blade 201. In one implementations, the extended portion 203 may be tangential to the blade curvature at the first trailing edge 204 as shown in FIG. 2A or, in another implementation, the extended portion 203 may be non-tangential to the blade curvature at the first trailing edge 204 (as shown in FIG. 2B). The extended portion 203 may be integrally formed with the curved portion 202 or alternatively, the extended portion 203 may be connected or fastened or joined to curved portion 202 by any attachment process or fastening means. Thus, in some implementations, the extended portion comprises a substantially flat outer surface or flat plate region, while in other implementations, the extended portion comprises a curved outer surface or curved plate region.

In FIG. 2A, for each blade, a tangential line 211 refers to a diameter of the impeller 200 which is tangent to the blade curvature. In some implementations, the extended portion 203 may extend from the first trailing edge 204 to a point on the tangential line 211 of the next blade, or a point beyond. Alternatively, in some implementations, the extended portion 203 may extend from the first trailing edge 204 to the second trailing edge 205.

As shown in FIG. 2C, extended-tip blade 201 may include an inlet blade angle ($\beta'_1$) 206 and an outlet blade angle ($\beta'_2$) 207. In different implementations, the inlet blade angle ("inlet angle") ($\beta'_1$) 206 may be between 5° and 70°. The inlet blade angle can be associated with the curvature along the blade length in a driver axial direction and can be variable along the blade length in some implementations. In addition, the outlet blade angle ("outlet angle") ($\beta'_2$) 207 may be between 120° and 180°. The outlet blade angle can be associated with the blade length in a driver axial direction and can be variable along the blade length in some implementations.

Thus, extended tip blades can comprise inlet blade angle values that differ from the value of the outlet blade angles. In some implementations, the value of the inlet blade angle can be substantially less than the value of the outlet blade angle. In one implementation, the value of the outlet blade angle can range between approximately 1.7 to 36 times than the value of the inlet blade angle. In the implementation shown in FIGS. 2A-2C, the extended portion 203 is tangent to the blade curvature at the first trailing edge 204. In FIG. 2C the inlet blade angle ($\beta'_1$) 206 may be understood to be reduced compared to conventional blades. In the impeller 200 of the present disclosure, the gas flow enters the extended-tip blades and is conducted or travels along blade channels with a negligible separation zone, or without resulting in a considerable or significant separation zone. Inlet angles of attack of up to 30° may not be associated with large adverse effects on performance and efficiency of impeller 200. For an extended-tip blade, for example extended-tip blade 201 increasing the outlet blade angle ($\beta'_2$) 207 to more than 120° and attaching extended portion 203 to the trailing edge of curved portion 202 may allow for the gas flow to be conducted in or travel along the channel between two consecutive blades and follow the curvature of the curved portion 202 without any considerable separation on the discharge portion of the blades. In other words, adverse effects on performance efficiency may be significantly reduced.

In the implementation of FIG. 2C, the profile of curved portion 202 of the extended tip blade 201 may be defined by four angles designated by α, Φ, Γ, and Ω. The angle α is the angle which is formed by connecting the leading edge 208 and the first trailing edge 204 to the center point of the profile of curved portion 202. In different implementations, the profile of the curved portion may be circular, elliptic or parabolic. In one implementations, in case of a circular curved portion, as shown in the example of FIG. 2C, a radius R of the curved portion 202 may be calculated by Equation (1):

$$R = \frac{d2 \times \left(1 - \frac{d1}{d2}\right)}{2\mathrm{Cos}(\Phi) \times \mathrm{Sin}(\alpha)} \times \mathrm{Sin}(\Gamma) \qquad \text{Equation (1)}$$

Referring to FIG. 2C, the angle between a first tangent line 209 to the curved portion 202 at the first trailing edge 204 and a second tangent line 210 to the leading edge 208 of the curved portion 202 is designated by Ω; the angle between the line that extends between the leading edge 208 and the first trailing edge 204 of the curved portion 202 and the radius of the curved portion 202 is designated by Γ; and the angle between the line connecting the leading edge 208 and the first trailing edge 204 and the radius of the inner circle 214 is designated by Φ. As described below, in some implementations, angles α, Φ, Γ, and Ω may be related to the inlet blade angle 206 and outlet blade angle 207, as follows:

$$\Omega = 180 - \beta'_2 + \beta'_1$$

$$\alpha = \beta'_2 - \beta'_1$$

$$\Phi = (\beta'_1 - (180 - \beta'_2))/2$$

$$\Gamma = (\beta'_1 + (180 - \beta'_2))/2$$

EXAMPLE

For purposes of clarity, an example is described in which two impellers with between-bearings configurations have been constructed. While specific dimensions and configurations are described below, in other implementations, it should be understood that the values can be adjusted while still providing the benefits of the disclosed invention. For example, the number of blades, the inner diameters and outer diameters, the inlet angles and outlet angles, the radii, the thicknesses of various components, the speed of rotation, and other features can be adjusted as necessary for the system within the scope of the disclosure presented above.

In the following example, the first impeller is an arc-extended tip blade impeller in which the inner diameter of the impeller is approximately 430 mm and the outer diameter of the impeller is approximately 475 mm. In addition, 68 extended-tip blades are arranged in the first impeller cage, and the first impeller rotates at a speed of approximately 500 rpm. The extended-tip blades have an inlet angle of approximately 26° and an outlet angle of approximately 169° and the radius of the circular curved portion of each blade is about 14 mm. The extended portion has a length of about 15 mm and is tangential to the curved portion at the first trailing edge. The inner diameter of the shroud is approximately 430 mm and the outer diameter of the shroud is approximately 470 mm. The width of the impeller is approximately 400 mm. Each extended-tip blade has a thickness of approximately 1 mm.

Moreover, for purposes of comparison in this example, a second impeller that does not include an extended portion was constructed. An inner diameter of the second impeller is approximately 430 mm, and an outer diameter of the second impeller is approximately 470 mm. In addition, 68 blades are arranged in the second impeller cage and the second impeller rotates at a speed of about 500 rpm. The inlet angle of the blades in the second impeller is about 108° and the outlet angle of the curved portion is about 108°. The radius of each blade is approximately 25 mm. The inner diameter of the shroud is approximately 430 mm and the outer diameter of the shroud is approximately 470 mm. The width of the impeller is approximately 400 mm. Each extended-tip blade has a thickness of approximately 1 mm. In order to compare the efficiency of the first impeller (with extended-tip blades) and the second impeller, some tests were run and the results are shown in FIGS. 3A and 3B.

Figure 3A:
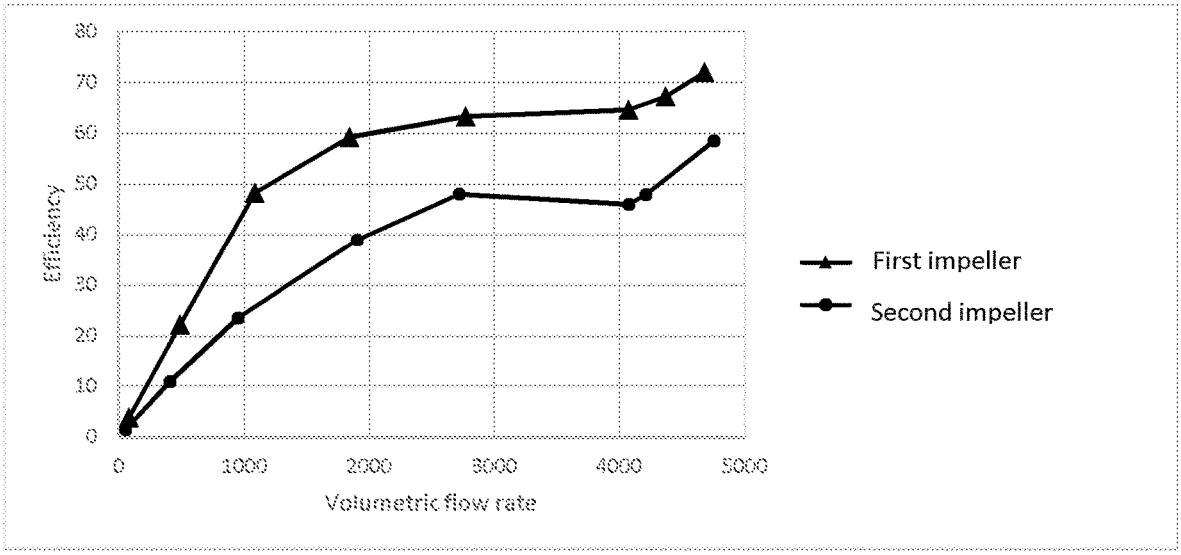
FIG. 3A is an efficiency vs. volumetric chart for an implementation of two exemplary impellers: an impeller with extended-tip blades (designated by ▲) and an impeller with blades without the extended portion (designated by ●)

FIG. 3A presents the efficiency of the first impeller and the second impeller at different volumetric flow rates. Fan efficiency is defined by $(Q \times \Delta P)/P_{FI}$, where Q=Volume Flow Rate in $m^3$/sec., and $P_{FI}$=Fan Input Power in Watts. Furthermore, as the fan sucked air from laboratory so, it is understood that the Pressure Difference ΔP was equal to a summation of dynamic and static pressures at fan discharge. In other words, $\Delta P = P_d + P_s$ where the related units are in Pascals. Dynamic Pressure, or $P_d$, is equal to $(\rho/2) \times V$. Density of air or ρ is calculated from the air temperature AMSL (above mean sea level). Air Outlet Velocity in the outlet duct, or V, was measured by Pitot tube. The outlet duct was connected to Volute Discharge. In addition, $P_s$ or Outlet Static pressure of fan was measured by Pitot tube. Fan Input Power is equal to $P_I \times \eta_m$ where $P_I$ is Electrical Motor Input Power and $\eta_m$ is Motor Efficiency at specified Motor RPM. To obtain a Fan Characteristic Curve at different points, a differently sized orifice has been installed in the outlet duct and in each step Fan Input Power, Air Outlet Velocity and Outlet Static pressure were measured. Pressure Difference is measured in Pascals, and Volume Flow Rate in $m^3$/hr. Efficiencies of the first impeller are designated by ▼ and efficiencies of the second impeller are designated by ●.

As shown in FIG. 3A, for each value of volumetric flow rate under the tested conditions, efficiency value for the first impeller—in which extended-tip blades are utilized—is considerably higher than the efficiency value for the second impeller that does not include an extended portion.

Figure 3B:
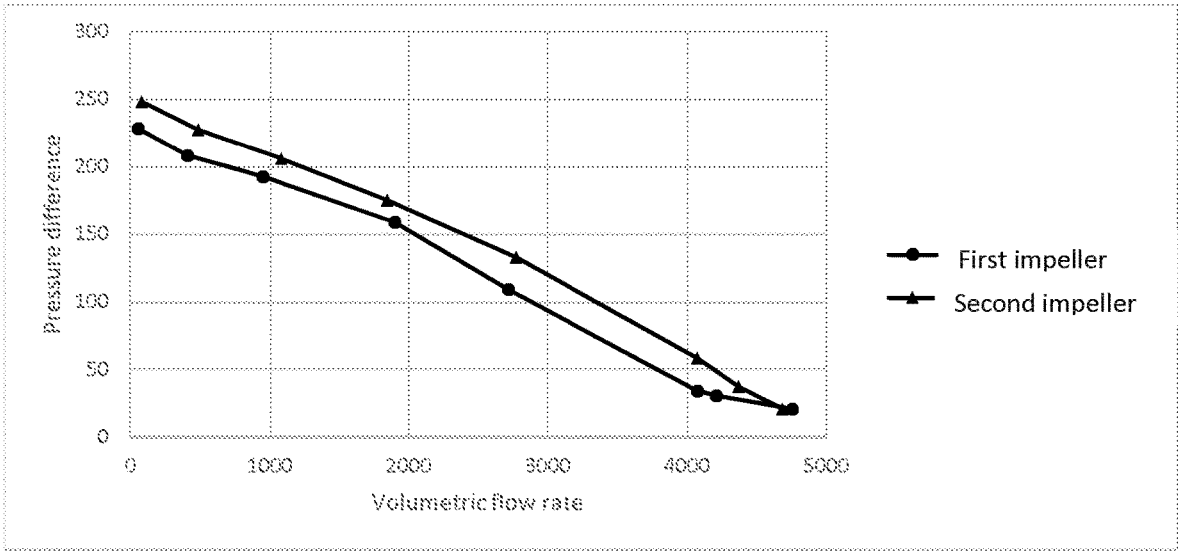
FIG. 3B is a pressure difference vs. volumetric chart for an implementation of two exemplary impellers: an impeller with extended-tip blades (designated by ▲) and an impeller with blades without the extended portion (designated by ●).

FIG. 3B depicts the pressure difference between the first impeller and the second impeller at different volumetric flow rates. The pressure difference is measured in Pascals and the volumetric flow rates are measured in $m^3$/hr. Pressure differences of the first impeller are designated by ▼ and pressure differences of the second impeller are designated by ●. As shown in FIG. 3B, for each value of volumetric flow rate, the pressure difference value for the first impeller—in which extended-tip blades are utilized—is considerably higher than pressure difference value for the second impeller.

Thus, in different implementations of the system described herein, the curved portion at the leading edge may have a relatively small inlet angle configured to decrease entry shock loss. In addition, the trailing edge may have large outlet angle to decrease the separation zone on the blade suction side and consequently accelerate outlet flow. This design can increase impeller performance and efficiency.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various implementations. This is for purposes of streamlining the disclosure, and is not to be interpreted as reflecting an intention that the claimed implementations require more features than are expressly recited in each claim. Rather, as the following claims reflect, inventive subject matter lies in less than all features of a single disclosed implementation. Thus, the following claims are hereby incorporated into the Detailed Description, with each claim standing on its own as a separately claimed subject matter.

While various implementations have been described, the description is intended to be exemplary, rather than limiting and it will be apparent to those of ordinary skill in the art that many more implementations and implementations are possible that are within the scope of the implementations. Although many possible combinations of features are shown in the accompanying figures and discussed in this detailed description, many other combinations of the disclosed features are possible. Any feature of any implementation may be used in combination with or substituted for any other feature or element in any other implementation unless specifically restricted. Therefore, it will be understood that any of the features shown and/or discussed in the present disclosure may be implemented together in any suitable combination. Accordingly, the implementations are not to be restricted except in light of the attached claims and their equivalents. Also, various modifications and changes may be made within the scope of the attached claims.

What is claimed is:

1. A forward-curved impeller for a centrifugal fan, the impeller comprising:

a plurality of blades including a first blade, each of the blades of the plurality of blades including a respective curved portion and a respective extended portion, each respective curved portion including a respective leading edge and a respective trailing edge;

the first blade comprising a first curved portion and a first extended portion;

the first curved portion including a first leading edge and a first trailing edge; and wherein:

the first extended portion extends outward from the first trailing edge of the first curved portion;

the forward-curved impeller includes an inner diameter and an outer diameter, the inner diameter being associated with a circle extending along the leading edges of the curved portions of all of the plurality of blades, the outer diameter being associated with a circle extending along the trailing edges of the curved portions of all of the blades, and wherein a ratio of the inner diameter to the outer diameter is at most 1; and the first blade includes:

an inlet blade angle in a range between 5° and 24°; and an outlet blade angle in a range between 160° and 180°.

2. The forward-curved impeller according to claim 1, wherein the first extended portion comprises a substantially flat outer surface.

3. The forward-curved impeller according to claim 1, wherein the first extended portion comprises a curved outer surface.

4. The forward-curved impeller according to claim 1, wherein the first curved portion includes a profile that is selected from the group consisting of a substantially elliptical profile, and a substantially parabolic profile.

5. The forward-curved impeller according to claim 1, wherein the inlet blade angle is variable along a length of the first blade.

6. The forward-curved impeller according to claim 1, wherein the outlet blade angle is variable along a length of the first blade.

7. The forward-curved impeller according to claim 1, wherein the extended portion is non-tangential to the curved portion at the trailing edge of the curved portion.

8. The forward-curved impeller according to claim 1, wherein the extended portion is tangential to the curved portion at the trailing edge of the curved portion.

9. The forward-curved impeller according to claim 1, wherein the first curved portion is a substantially circular curved portion, wherein a radius of the circular curved portion follows:

$$R = \frac{d2 \times \left(1 - \frac{d1}{d2}\right)}{2\mathrm{Cos}(\Phi) \times \mathrm{Sin}(\alpha)} \times \mathrm{Sin}(\Gamma)$$

Wherein, $\alpha = \beta'_2 - \beta'_1$ $\Phi = (\beta'_1 - (180 - \beta'_2))/2$ $\Gamma = (\beta'_1 + (180 - \beta'_2))/2$ and wherein, $d_1$ is an inner diameter of the impeller, $d_2$ is an outer diameter of the impeller, $\beta'_1$ is an inlet angle of the blade, and $\beta'_2$ is an outlet angle of the blade.

10. The forward-curved impeller according to claim 1, wherein the first blade includes an inlet blade angle that is at least 5° and an outlet blade angle that is at least 120°.

11. The forward-curved impeller according to claim 1, wherein the first blade includes an inlet blade angle that is at most 70° and an outlet blade angle that is at most 180°.

12. The forward-curved impeller according to claim 1, further comprising a second blade with a second extended portion, wherein a channel extends between the first blade and the second blade, and wherein the first extended portion and the second extended portion are configured to allow gas to flow through the channel with negligible separation loss.

13. The forward-curved impeller according to claim 10, wherein the outlet blade angle is approximately 169° and the inlet blade angle is approximately 26°.

14. The forward-curved impeller according to claim 1, wherein the inner diameter of the forward-curved impeller is approximately 430 mm and the outer diameter of the forward-curved impeller is approximately 475 mm.

15. The forward-curved impeller according to claim 1, wherein the first extended portion has a length of about 15 mm and is tangential to the first curved portion at the trailing edge.

16. The forward-curved impeller according to claim 1, wherein the first extended portion has a thickness of approximately 1 mm.

* * * * *